US008714380B2

(12) United States Patent
Casale et al.

(10) Patent No.: US 8,714,380 B2
(45) Date of Patent: May 6, 2014

(54) RECLOSABLE OPENING DEVICE FOR PACKAGES OF POURABLE FOOD PRODUCTS

(75) Inventors: Cristiano Casale, Spilamberto (IT); Angelo Sorbara, Modena (IT)

(73) Assignee: Tetra Laval Holding & Finance S.A., Pully (CH)

( * ) Notice: Subject to any disclaimer, the term of this patent is extended or adjusted under 35 U.S.C. 154(b) by 837 days.

(21) Appl. No.: 12/741,315

(22) PCT Filed: Nov. 5, 2008

(86) PCT No.: PCT/EP2008/065011

§ 371 (c)(1),
(2), (4) Date: May 4, 2010

(87) PCT Pub. No.: WO2009/060005

PCT Pub. Date: May 14, 2009

(65) Prior Publication Data

US 2010/0264146 A1 Oct. 21, 2010

(30) Foreign Application Priority Data

Nov. 5, 2007 (EP) ..... 07120020

(51) Int. Cl.
*B65D 17/42* (2006.01)
*B67D 1/00* (2006.01)

(52) U.S. Cl.
USPC ..... 215/297; 220/277; 220/258.4; 222/83

(58) Field of Classification Search
USPC ..... 220/267, 277, 258.4; 215/297; 408/204, 408/206; 222/80, 81, 83
See application file for complete search history.

(56) References Cited

U.S. PATENT DOCUMENTS 3,977,555 A * 8/1976 Larson ..... 215/247
4,007,848 A * 2/1977 Snyder ..... 215/44

(Continued)

FOREIGN PATENT DOCUMENTS

CH 695 019 A5 11/2005
EP 1 088 765 A1 4/2001

(Continued)

OTHER PUBLICATIONS

English language translation of the Decision of Grant issued by the Kazakhstan Patent Office in corresponding Kazakhstani Patent Application No. 2010/1565.1.

(Continued)

*Primary Examiner* — Anthony Stashick
*Assistant Examiner* — James N Smalley
(74) *Attorney, Agent, or Firm* — Buchanan Ingersoll & Rooney PC

(57) ABSTRACT

A reclosable opening device for a sealed package of a pourable food product includes a frame fitted about a pierceable portion of the package and defining a through pour opening; a removable threaded cap that screws onto the frame to close the pour opening; a tubular cutter engaging the pour opening and having a cutting device which cooperates with the pierceable portion to unseal the package; a first connector connecting the cap to the cutter, and which, as the cap is unscrewed, pushes the cutter towards the pierceable portion and a second connector connecting the frame to the cutter, and which, in use, feed the cutter along a predetermined piercing path through the pierceable portion in response to unscrewing of the cap; and the piercing path, as the cap is unscrewed, has a first portion of pure axial translation, followed by a second portion of both axial and rotary motion.

25 Claims, 5 Drawing Sheets

(56) References Cited

U.S. PATENT DOCUMENTS

| | | | | |
|---|---|---|---|---|
| 4,410,128 | A | 10/1983 | Rausing | |
| 4,655,387 | A | 4/1987 | Magnusson | |
| 4,771,905 | A * | 9/1988 | Perne et al. | 215/270 |
| 5,193,712 | A * | 3/1993 | Kuppersbusch | 229/117.3 |
| 5,366,114 | A | 11/1994 | Bernstein et al. | |
| 5,564,622 | A * | 10/1996 | Wald | 229/125.04 |
| 6,006,930 | A * | 12/1999 | Dreyer et al. | 215/44 |
| 6,279,779 | B1 | 8/2001 | Laciacera et al. | |
| 6,364,164 | B1 | 4/2002 | Troiano | |
| 6,820,764 | B2 | 11/2004 | Miani et al. | |
| 7,207,465 | B2 | 4/2007 | Weist | |
| 7,458,486 | B2 | 12/2008 | Weist et al. | |
| 7,878,353 | B2 | 2/2011 | Casale et al. | |
| 2003/0173325 | A1 * | 9/2003 | Mavin | 215/270 |
| 2005/0242113 | A1 | 11/2005 | Weist | |
| 2006/0071000 | A1 | 4/2006 | Weist et al. | |

FOREIGN PATENT DOCUMENTS

| | | | |
|---|---|---|---|
| EP | 1 338 521 | A1 | 8/2003 |
| EP | 1 396 435 | A1 | 3/2004 |
| EP | 1 627 819 | A1 | 2/2006 |
| EP | 1 513 732 | B1 | 3/2006 |
| JP | 1-137861 | U | 9/1989 |
| JP | 3-72621 | U | 7/1991 |
| JP | 5-51032 | A | 3/1993 |
| JP | 11-222268 | A | 8/1999 |
| JP | 2001-97416 | A | 4/2001 |
| JP | 2004-514612 | A | 5/2004 |
| JP | 2005-510424 | A | 4/2005 |
| JP | 2005-533725 | A | 11/2005 |
| WO | WO 95/05996 | A1 | 3/1995 |
| WO | 02/44040 | A1 | 6/2002 |
| WO | 2005/077774 | A1 | 8/2005 |

OTHER PUBLICATIONS

International Search Report issued on Jun. 19, 2009 by the European Patent Office as the International Searching Authority in International Application No. PCT/EP2008/065011.

Written Opinion issued on Jun. 19, 2009 by the European Patent Office as the International Searching Authority in International Application No. PCT/EP2008/065011.

Official Action issued Nov. 27, 2009 by the European Patent Office in European Patent Application No. 07120020.8, 4 pages.

Translation of opposition writ by SIG Technology (Switzerland) dated Nov. 4, 2011 against European Patent No. 2055640, 9 pages.

Japanese Office Action issued Jan. 11, 2013 by the Japanese Patent Office in Japanese Patent Application No. 2010-531548 and English language translation of Office Action (5 pgs).

Official Decision of Grant issued Mar. 21, 2013 by the Patent Office of the Russian Federation in Russian Patent Application No. 2010123018 and partial English language translation of Official Decision of Grant (14 psgs)

* cited by examiner

RECLOSABLE OPENING DEVICE FOR PACKAGES OF POURABLE FOOD PRODUCTS

TECHNICAL FIELD

The present invention relates to a reclosable opening device for packages of pourable food products.

BACKGROUND ART

As is known, many pourable food products, such as fruit juice, UHT (ultra-high-temperature treated) milk, wine, tomato sauce, etc., are sold in packages made of sterilized packaging material.

A typical example of this type of package is the parallelepiped-shaped package for liquid or pourable food products known as Tetra Brik Aseptic (registered trademark), which is made by folding and sealing laminated strip packaging material. The packaging material has a multilayer structure comprising a layer of base material, e.g. paper, covered on both sides with layers of heat-seal plastic material, e.g. polyethylene. In the case of aseptic packages for long-storage products, such as UHT milk, the packaging material comprises a layer of oxygen-barrier material, e.g. aluminium foil, which is superimposed on a layer of heat-seal plastic material, and is in turn covered with another layer of heat-seal plastic material forming the inner face of the package eventually contacting the food product.

Packages of this sort are normally produced on fully automatic packaging machines, on which a continuous tube is formed from the web-fed packaging material; the web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating; and the web of packaging material so sterilized is maintained in a closed, sterile environment, and is folded and sealed longitudinally to form a vertical tube.

The tube is filled with the sterilized or sterile-processed food product, and is sealed and subsequently cut along equally spaced cross sections to form pillow packs, which are then folded mechanically to form respective finished, e.g. substantially parallelepiped-shaped, packages.

Alternatively, the packaging material may be cut into blanks, which are formed into packages on forming spindles, and the packages are filled with the food product and sealed. One example of this type of package is the so-called "gable-top" package known by the trade name Tetra Rex (registered trademark).

To open the above packages, various solutions have been proposed, a first one of which, described in U.S. Pat. No. 4,655,387 and U.S. Pat. No. 4,410,128, comprises forming, at the corner of a flap on the package, a preferential tear line defined by a succession of perforations extending through the outer layers of the packaging material down to the layer of barrier material. And the package is opened by lifting up the flap and cutting or tearing along the perforations. Once opened, packages of this sort, obviously, cannot be closed again, and must be handled with care, until all the food product is consumed, to prevent spillage of the product from the package.

To eliminate this drawback, the above packages have been fitted with reclosable opening devices, which substantially comprise a frame defining a through opening and applied to a hole or a pierceable or removable portion of a wall of the package; and a cap hinged to the frame. The cap is normally molded integrally with the frame, and is initially sealed to it, along a peripheral edge surrounding the opening, by a thin, breakable annular connecting portion. Once unsealed, the cap is movable between a closed position cooperating in fluidtight manner with the frame, and an open position.

Alternatively, threaded caps, separate from and initially screwed to the frame, are also used. In which case, the cap is normally molded integrally with a tamperproof ring connected coaxially to the cap by breakable radial connecting elements. More specifically, the cap is pressed onto the frame to click the tamperproof ring past the thread portion of the frame closest to the package; and, when the package is unsealed, the breakable connecting elements break off to detach the cap from the tamperproof ring, which remains where it is.

One problem of the opening devices described is that the cap must be removable from the frame or tamperproof ring with practically no effort when unsealing the package. For which purpose, the opening devices are made of easy-break plastic material, normally polyethylene.

Polyethylene, however, has the drawback of being a poor oxygen barrier. So, when the hole is formed through the full thickness of the packaging material, an additional cover element or "patch", defined by a small sheet of heat-seal plastic material, must be applied over the hole on the side of the packaging material eventually forming the inside of the package; and the opposite side of the packaging material must be fitted with an oxygen-barrier element, e.g. a pull tab, which is heat sealed to the patch and comprises a layer of aluminium.

Fitting the package with a barrier element and patch, however, means additional work on the packaging material before it is sterilized and folded and sealed into a vertical tube, thus increasing the time and cost of producing the package.

Moreover, after unsealing the cap, the user also has to remove the barrier element for access to the contents of the package.

Alternatively, the hole may only be formed through the base layer of the packaging material, and is covered completely when the layers of heat-seal plastic material and barrier material are applied to the base layer.

In this case too, however, when unsealing the package, the user has to perform two successive operations: unseal the cap and either pierce or remove the material covering the hole in the base layer for access to the contents of the package.

Reclosable opening devices have therefore been proposed, designed to open the package in one operation, even when access to the contents of the package calls for piercing the packaging material.

In the solution described, for example, in international Patent Application WO 95/05996, opening devices of this sort substantially comprise a frame having a cylindrical collar defining a pour opening and fitted about a pierceable portion of the package; a removable cap screwed to the outside of the frame collar to close the pour opening; and a substantially tubular cylindrical cutter screwed inside the frame collar, and which cooperates with the pierceable portion of the package to detach it partly, i.e. with the exception of a small-angle flap, from the relative wall.

The cutter is activated by the cap by means of one-way ratchet-type transmission means, which are active when removing the cap from the collar. In the specific case described in the above international patent application, the cutter acts on the pierceable portion by means of an end edge parallel to the pierceable portion and having a number of teeth, all triangular and of the same height.

In actual use, the cutter moves spirally, with respect to the frame, from a raised rest position, in which the end teeth face the pierceable portion, into successive lowered cutting positions, in which the end teeth interact simultaneously with the pierceable portion.

One drawback of opening devices of the above type is that the teeth tend to "chew" the pierceable portion material, thus resulting in a jagged, frayed cut edge, the flaps of which tend to project through the pour opening and, at times, divert flow of the food product as it is poured out. Moreover, the cut-off part of the pierceable portion remains hanging inside the package, and, in use, tends to at least partly clog the flow section of the pour opening, thus seriously interfering with outflow of the product from the package.

To improve detachment of the pierceable portion from the rest of the packaging material, it has been proposed to make the cutter of more rigid material (e.g. polypropylene) than the frame and cap (normally made of polyethylene). This may result, however, in making the end teeth of the cutter overly fragile, thus resulting in potential breakage during transport and/or when unsealing the package, and dispersion of the teeth inside the food product.

To improve the efficiency of the cutter, various solutions have been proposed, the most significant would appear to be those described in Patent EP-B-1513732 and Patent Application US 2005/0242113.

More specifically, in the first of the above solutions, the cutter is guided, as it penetrates the wall of the package, so that its travel comprises a first purely vertical translation portion, and a second purely horizontal rotation portion.

In the second solution, the travel of the cutter, when unsealing the package, comprises a first spiraling portion, and a second purely horizontal rotation portion.

Though improving cutting quality of the pierceable portion from the rest of the packaging material, the above solutions are still not altogether satisfactory in achieving a clean cut with no frayed flaps projecting through the pour opening, and in solving the problem of the cut-off part of the pierceable portion interfering with pour-out of the product from the package.

Finally, it should be pointed out that the above limitations are particularly noticeable when the pierceable portion of the package is made of particularly tough material, e.g. a barrier material covered with a polymer catalyzed with an organometal or metallocene. In which case, the pierceable portion tends to "stretch" rather than tear under the action of the cutter, thus leaving threads on the cutter that may be passed on to the food product.

DISCLOSURE OF INVENTION

It is an object of the present invention to provide a reclosable opening device designed to more effectively cut the pierceable portion as compared with known opening devices, and which, at the same time, provides a valid solution to the problem of the cut-off part interfering with pour-out of the product.

According to the present invention, there is provided a reclosable opening device for a sealed package of a pourable food product, said opening device having an axis, and comprising:

a frame fitted about a pierceable portion of said package, and defining a through pour opening coaxial with said axis;

a removable threaded cap that screws onto said frame to close said pour opening;

a tubular cutter engaging said pour opening and having, at one axial end, cutting means which cooperate with said pierceable portion to unseal said package;

first connecting means connecting said cap to said cutter, and which, in use, as the cap is unscrewed off the frame, push the cutter towards said pierceable portion; and second connecting means connecting said frame to said cutter, and which, in use, feed the cutter along a predetermined piercing path through said pierceable portion in response to unscrewing of said cap;

and being characterized in that said piercing path of the cutter, as said cap is unscrewed off said frame, comprises a first portion of pure translation along said axis, followed by a second portion having both an axial component of motion and a rotary component of motion about said axis.

By virtue of the movement of the cutter, the pierceable portion of the package can be cut leaving no residual threads, even when using an internal layer of high-stretch heat-seal plastic material.

Moreover, the combined translation-rotation movement following the purely axial translation movement ensures the cut-off part of the material is folded clear of the food product pour-out flow section. More specifically, the cut-off part of the material is enclosed between the frame and the cutter, thus in no way interfering with pour-out flow of the food product.

Another point in connection with known opening devices—both three-part, i.e. comprising a frame, cap, and cutter, and two-part, i.e. without the cutter—is the limitation in the diameter of the pour opening defined by the frame.

As is known, the top wall of packages made from a tube of packaging material has sealing bands, which reduce the space available on the top wall to apply the opening device. More specifically, the top wall is crossed along the centreline by a folded flat transverse sealing band coplanar with the top wall, and by an end portion of a flat longitudinal sealing band perpendicular to the transverse sealing band. More specifically, the longitudinal sealing band extends across a portion of the top wall of the package and, from there, downwards along a lateral wall and the bottom wall of the package.

Similarly, packages formed on forming spindles also have a top wall crossed along the centreline by a folded flat transverse sealing band coplanar with the top wall.

In both cases, opening devices cannot be applied to the sealing bands of the packages, both on account of the problems posed by sealing the opening devices on uneven surfaces, and the need to ensure effective sealing of the packages.

As a result, opening devices are normally always applied to the small flat areas adjacent to the sealing bands on the top wall of the packages, which obviously poses a limit to the maximum size of the opening device.

This is particularly important in view of the increasing number of physically different food products now packaged as described above, i.e. in packages made of paper packaging material. More specifically, some food products, particularly semiliquid products or products containing fibres or particles, necessarily require larger opening devices to ensure smooth pour-out of the product with no clogging.

It is therefore another object of the invention to provide a reclosable opening device having a larger pour opening than known opening devices, and which, at the same time can be applied in the limited space available on pourable food product packages, without interfering with the sealing bands.

According to the present invention, there is provided a reclosable opening device for a sealed package of a pourable food product, said opening device comprising a frame fitted about a hole or a pierceable portion of said package and defining a through pour opening; and a removable cap fitted to said frame to close said pour opening;

and being characterized in that said frame comprises a first and a second portion at an angle to each other and fixed to respective walls, also at an angle to each other, of said package, so as to extend across an edge between said walls.

By virtue of the above configuration, it is possible to maximize the diameter of the pour opening and so greatly improve pour-out flow of the food product from the package.

It should be pointed out that the configuration described of the opening device frame applies, not only to three-part opening devices, such as the one referred to in the following description, but also to two-part opening devices, i.e. having no cutter, and which can therefore be applied about pierceable or removable portions of the package, as well as about through holes through the full thickness of the packaging material.

Other points in connection with known opening devices—both three-part, i.e. comprising a frame, cap, and cutter, and two-part, i.e. without the cutter—are maximizing the ease with which the product can be drunk directly from the package, and minimizing the effort required of the user to unseal the package.

It is therefore another object of the present invention to provide a reclosable opening device designed to solve at least one of the points referred to in the preceding paragraph.

According to the present invention, there is provided a reclosable opening device for a sealed package of a pourable food product, said opening device comprising:

a frame having an annular base flange fitted about a hole or a pierceable portion of said package; and a tubular cylindrical collar, which projects from said flange, on the opposite side to that fixed to said package, defines a through pour opening, and has a thread; and a removable cap, which is fitted to said collar of said frame, to close said pour opening, by a thread of the cap engaging the thread of the collar;

and being characterized in that said collar comprises, along its outer cylindrical surface, at least one perfectly smooth portion extending between two distinct generating lines of the outer cylindrical surface, and which defines a comfortable support for the user's mouth in the event the food product is consumed directly from the package.

In one possible variation, said thread of said collar extends along said outer cylindrical surface, and is interrupted by said smooth portion.

This solution therefore provides for improved comfort, when drinking directly from the package, by simply forming a smooth lip-supporting area on the externally threaded collar of the frame.

In another variation, the whole outer cylindrical surface of said collar is smooth, and said thread of said collar is formed on an opposite inner cylindrical surface defining said pour opening Moreover, the cap comprises a circular end wall; and two substantially cylindrical lateral walls projecting coaxially from said end wall and defining, between them, an annular gap loosely housing said collar of said frame; the radially inner lateral wall of said cap having, along its surface facing said gap, said thread engaging the thread of said frame.

This configuration of the cap and frame of the opening device according to the invention has the following advantages:

utmost comfort, by the user's mouth resting on a completely smooth surface, when consuming the product directly from the package;

the cap having an outer lateral wall not contacting the collar of the frame (the cap is connected to the frame by the radially inner wall) means that, when gripped by the user to open the package, the outer lateral wall is deformable, is therefore pleasantly soft to the touch, and so gives the user the impression the package is easy to open;

the outer lateral wall of the cap may easily be provided with a tamperproof tab of the type only covering an angular portion of the bottom edge of the outer lateral wall and hinged to open outwards; in which case, since the outer lateral wall has no thread, the tamperproof tab, once rotated outwards when unsealing the package, in no way impedes replacing the cap.

BRIEF DESCRIPTION OF THE DRAWINGS

A preferred, non-limiting embodiment of the present invention will be described by way of example with reference to the accompanying drawings, in which.

BEST MODE FOR CARRYING OUT THE INVENTION

Figure 1:
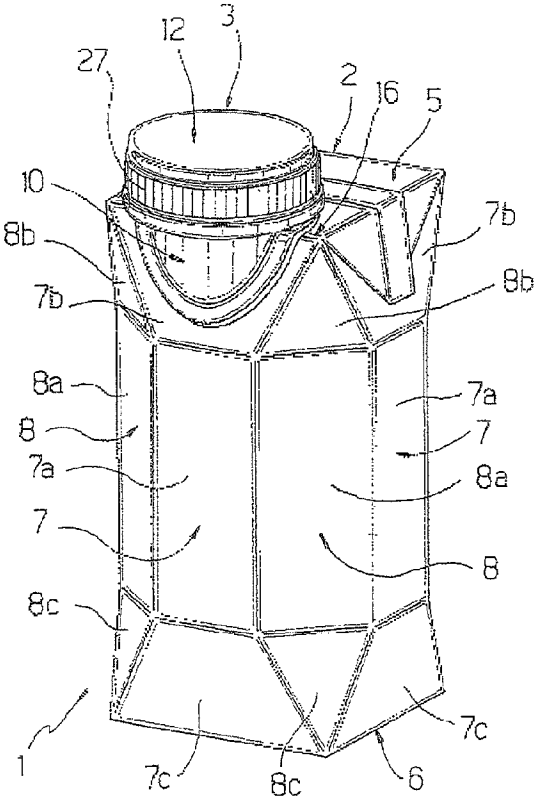
FIG. 1 shows a view in perspective of a sealed package for pourable food products, featuring a reclosable opening device in accordance with the present invention.
Figure 7:
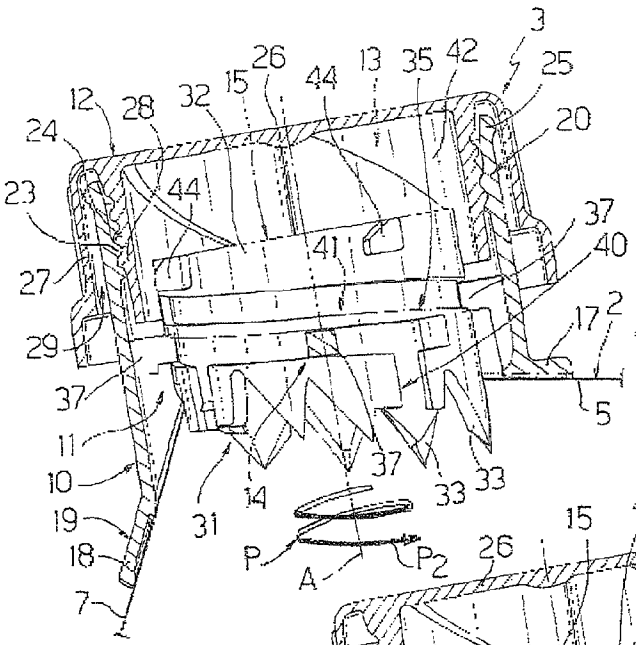
FIGS. 4 to 8 show sections of the opening device according to the invention at successive stages in unsealing the package.
Figure 8:
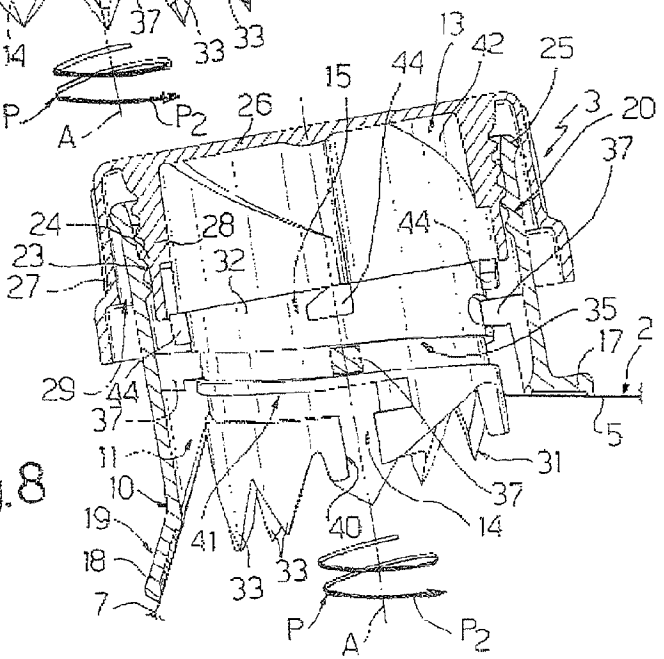

Number 1 in FIG. 1 indicates as a whole a sealed package for pourable food products, which is made of sheet packaging material and is fitted, on a top portion 2, with a reclosable opening device 3 of plastic material.

Opening device 3 is applied to top portion 2 of package 1 by conventional fastening systems, such as adhesives, or by microflame, direct-current-induction, ultrasound, laser, or other heat-sealing techniques.

The packaging material has a multilayer structure comprising a layer of base material, e.g. paper, covered on both sides with layers of heat-seal plastic material, e.g. polyethylene. In the case of aseptic packages for long-storage products, such as UHT milk, the packaging material also comprises a layer of oxygen-barrier material, e.g. aluminium foil, which is superimposed on a layer of heat-seal plastic material, and is in turn covered with one or more layers of heat-seal plastic material. The inner layer of heat-seal plastic material contacting the product, in use, may, for example, be made of strong, in particular, high-stretch, metallocene-catalyzed, low-linear-density (LLD) polyethylene.

In the non-limiting example shown in the attached drawings, package 1 is of the type described in Patent EP-A-1338521.

More specifically, package 1 comprises a quadrilateral (in the example shown, rectangular or square) top wall 5; a quadrilateral (in this case, rectangular or square) bottom wall 6; four lateral walls 7 extending between top wall 5 and bottom wall 6; and four corner walls 8, each located between a respective pair of adjacent lateral walls 7 and also extending between top wall 5 and bottom wall 6.

Each lateral wall 7 comprises a rectangular intermediate portion 7*a*; and opposite, respectively top and bottom, isosceles-trapezium-shaped end portions 7*b*, 7*c*, the minor bases of which are equal and defined by opposite horizontal sides of intermediate portion 7*a*, and the major bases of which coincide with the corresponding sides of top wall 5 and bottom wall 6 respectively.

Each corner wall 8 comprises a rectangular intermediate portion 8*a*; and opposite, respectively top and bottom, triangular end portions 8*b*, 8*c*, the bases of which are equal and defined by opposite horizontal sides of intermediate portion 8*a*, and the apexes of which coincide with the corners of top wall 5 and bottom wall 6 respectively. In other words, in the FIG. 1 configuration, the top end portions 8*b* have upward-facing apexes, and the bottom end portions 8*c* have downward-facing apexes.

On the side facing inwards of package 1, each end portion 7*b*, 7*c*, 8*b*, 8*c* forms an angle of over 90° but less than 180° with the adjacent top wall 5 or bottom wall 6.

In use, opening device 3 covers a pierceable portion 4 of package 1; which pierceable portion 4 is detachable at least partly from the rest of the packaging material to permit pour-out of the product from package 1.

With reference to the attached drawings, opening device 3 has an axis A, and comprises a frame 10 fitted to package 1, about pierceable portion 4, and having a circular opening 11, of axis A, through which the food product is poured; a removable screw cap 12 fitted coaxially to frame 10 to close opening 11; and a tubular cutter 15, of axis A, which engages opening 11 in axially and angularly movable manner, in use, and interacts with pierceable portion 4 of package 1 to partly detach the pierceable portion from the rest of the packaging material to open package 1.

Opening device 3 also comprises first connecting means 13 connecting cap 12 to cutter 15, and which, in use, as cap 12 is unscrewed off frame 10, push cutter 15 towards pierceable portion 4; and second connecting means 14 connecting frame 10 to cutter 15, and which, in use, feed cutter 15 along a predetermined piercing path P through pierceable portion 4 in response to unscrewing of cap 12.

Frame 10 advantageously crosses an edge 16 between two adjacent walls of package 1—in the example shown, between top wall 5 and top end portion 7*b* of one of lateral walls 7—and comprises a first and second portion 17, 18 at a predetermined angle to each other and fixed to said walls 5 and 7 respectively.

More specifically, frame 10 comprises an annular base flange 19 defining portions 17 and 18 fastening the frame to respective walls 5, 7; and a tubular, cylindrical collar 20, of axis A, which projects from a radially inner edge of flange 19, on the opposite side to that fixed to walls 5, 7, defines opening 11, and is designed to receive cap 12.

As shown in the attached drawings, the angle formed by portions 17 and 18 of flange 19, on the side facing walls 5, 7, is an angle of 90° or more and less than 180°.

Collar 20 (FIGS. 2 and 3) advantageously comprises a smooth outer cylindrical surface 21 for comfortably supporting the user's mouth when consuming the food product directly from package 1; and an opposite inner cylindrical surface 22 defining opening 11 and having a thread 23 that engages a thread 24 of cap 12 in use.

In a preferred embodiment, collar 20 comprises, at the opposite end to flange 19, an outward-projecting annular end edge 25 (FIGS. 2 and 3) to further improve pour-out of the food product and user comfort when consuming the product directly from package 1. In the latter case, in fact, the user's bottom lip "locks" so to speak onto projecting annular edge 25 when drinking.

Cap 12 comprises a circular end wall 26; and two substantially cylindrical lateral walls 27, 28 projecting coaxially from end wall 26 and defining, between them, an annular gap 29 loosely housing collar 20 of frame 10 when opening device 3 is closed.

More specifically, lateral wall 27 extends from the peripheral lateral edge of end wall 26, whereas lateral wall 28 is located radially inwards of wall 27 with reference to axis A.

Thread 24 of cap 12 is formed along a surface 30 (FIGS. 2 and 3) of lateral wall 28 facing lateral wall 27 and therefore facing inwards of gap 29. When cap 12 is fitted to frame 10 (FIGS. 1, 4, 5, 6, 7, 8) lateral wall 27 covers the outside of, and is kept radially detached by, collar 20.

Cutter 15 is initially fitted completely inside collar 20 of frame 10 (FIG. 4), and, after package 1 is unsealed, is positioned partly inside the package (FIG. 8), after partly detaching pierceable portion 4 from the rest of the packaging material.

At one axial end, cutter 15 (FIGS. 2 to 10) has a cutting edge 31 that interacts with pierceable portion 4 of package 1 to detach it partly from the adjacent packaging material. Cutting edge 31 lies in a plane sloping with respect to the plane of an opposite axial end 32 of cutter 15.

Cutting edge 31 comprises a number of substantially triangular teeth 33 separated by one or more areas 34 of a given angular dimension, withdrawn axially with respect to teeth 33, and having no cutting function.

With reference to FIGS. 2 to 10, connecting means 14 comprise a cam profile 35 formed on the outer lateral surface 36 of cutter 15 (FIGS. 2 and 3) and defining the piercing path P of cutter 15 through pierceable portion 4; and a number of—in the example shown, four—catches 37 located on inner surface 22 of collar 20 of frame 10, equally spaced angularly about axis A, and which cooperate with and slide along cam profile 35.

Piercing path P, defined by cam profile 35 and travelled by cutter 15 as cap 12 is unscrewed off frame 10 when unsealing package 1, advantageously comprises a first portion $P_1$ (FIGS. 4 to 6) of pure translation along axis A, followed by a second portion $P_2$ (FIGS. 7, 8) having both an axial component of motion and a rotary component of motion about axis A.

More specifically, portion $P_2$ of piercing path P of cutter 15 is spiral.

Cam profile 35 is defined by a groove formed on outer lateral surface 36 of cutter 15, and comprises a straight portion 40, parallel to axis A, for each catch 37; and a helical portion 41 extending about axis A and into which portions 40 extend.

Catches 37 of frame 10 are projections projecting from inner surface 22 of collar 20.

As shown in FIGS. 2 to 10, straight portions 40 of cam profile 35 extend from cutting edge 31 of cutter 15, and come out inside helical portion 41, which in turn extends towards axial end 32 of cutter 15.

With particular reference to FIGS. 2, 3, 9 and 10, connecting means 13 comprise a number of—in the example shown, four—cam actuating members 42 located on a surface 43, opposite surface 30, of lateral wall 28 of cap 12, and equally spaced angularly about axis A; and a number of corresponding cam followers 44 located on outer lateral surface 36 of cutter 15, close to axial end 32, and which are subjected to thrust by respective actuating members 42 as cap 12 is unscrewed off frame 10 when unsealing the package.

In other words, actuating members 42 and corresponding cam followers 44 together define a one-way actuating device, by which cap 12 is connected rotationally to cutter 15 in the unscrewing direction of cap 12 (anticlockwise in the drawings), but disconnected in the opposite direction.

Actuating members 42 and cam followers 44 are defined by contoured projections projecting from surface 43 of cap 12 and outer lateral surface 36 of cutter 15 respectively.

Each actuating member 42 (FIG. 3) comprises a first strip portion 45 extending parallel to axis A and adjacent to the axial end edge of lateral wall 28 opposite end wall 26; and a second portion 46 adjacent to end wall 26 and substantially in the shape of a right triangle with one cathetus extending along the extension of strip portion 45, and the other cathetus defined by end wall 26.

The hypotenuse of right-triangle portion 46 of each actuating member 42 defines the thrust side of portion 46 acting on relative cam follower 44.

The edge, indicated 49, of each actuating member 42 on the hypotenuse side is perpendicular to lateral wall 28 of cap 12, while the edge, indicated 50, of actuating member 42 on the opposite side is bevelled, so that cam followers 44 can only be actuated in one rotation direction of cap 12, i.e. that in which edge 49 of each actuating member 42 contacts relative cam follower 44.

Figure 3:
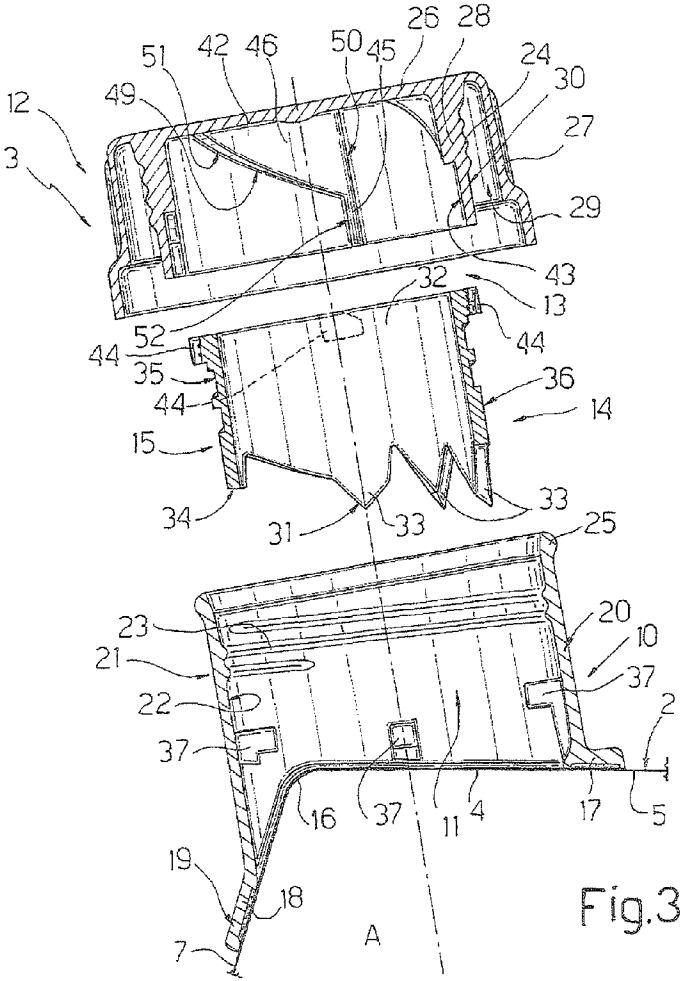
FIGS. 2 and 3 show larger-scale, partly sectioned, exploded side views of the FIG. 1 opening device.
Figure 10:
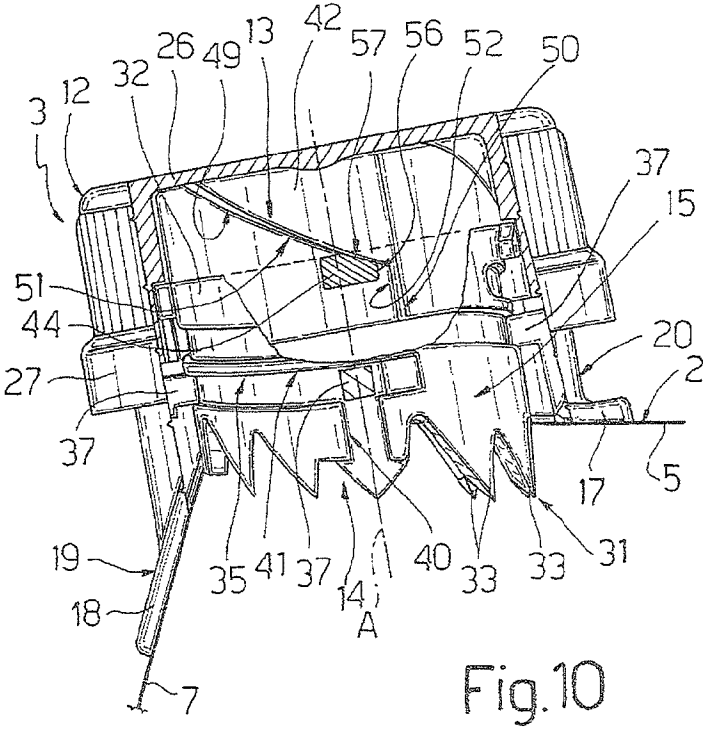
FIGS. 9 and 10 show partly sectioned side views of the opening device according to the invention at the FIGS. 5 and 6 stages respectively.
Figure 9:
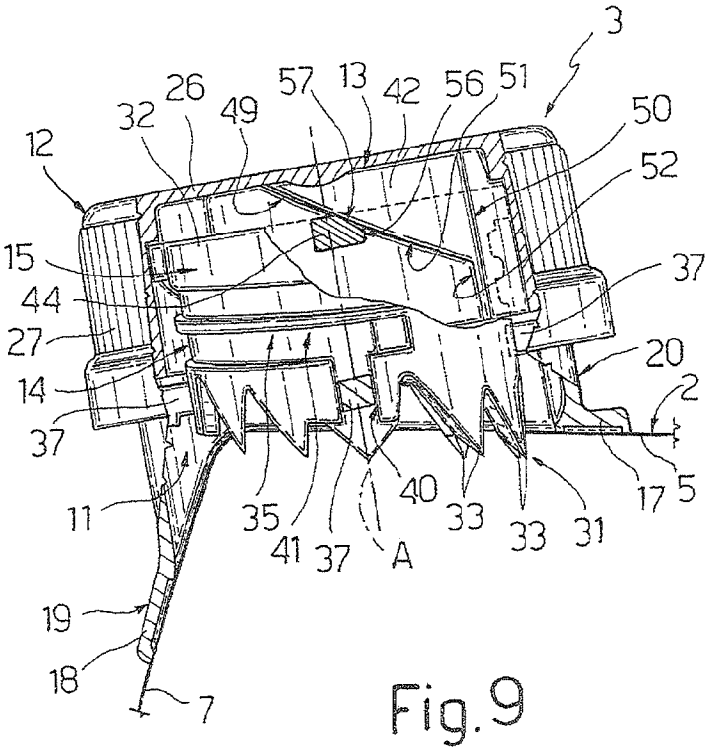

As shown, in particular in FIGS. 3, 9 and 10, edge 49 of each actuating member 42 therefore defines a sort of cam profile, and comprises a first portion 51 substantially oblique with respect to axis A (the hypotenuse of substantially right-triangle-shaped portion 46), and along which unscrewing of cap 12 off frame 10 corresponds to axial thrust on relative cam follower 44; and a straight second portion 52 parallel to axis A (the edge of strip portion 45), and along which unscrewing of cap 12 corresponds to rotation of relative cam follower 44 about axis A.

Figure 2:
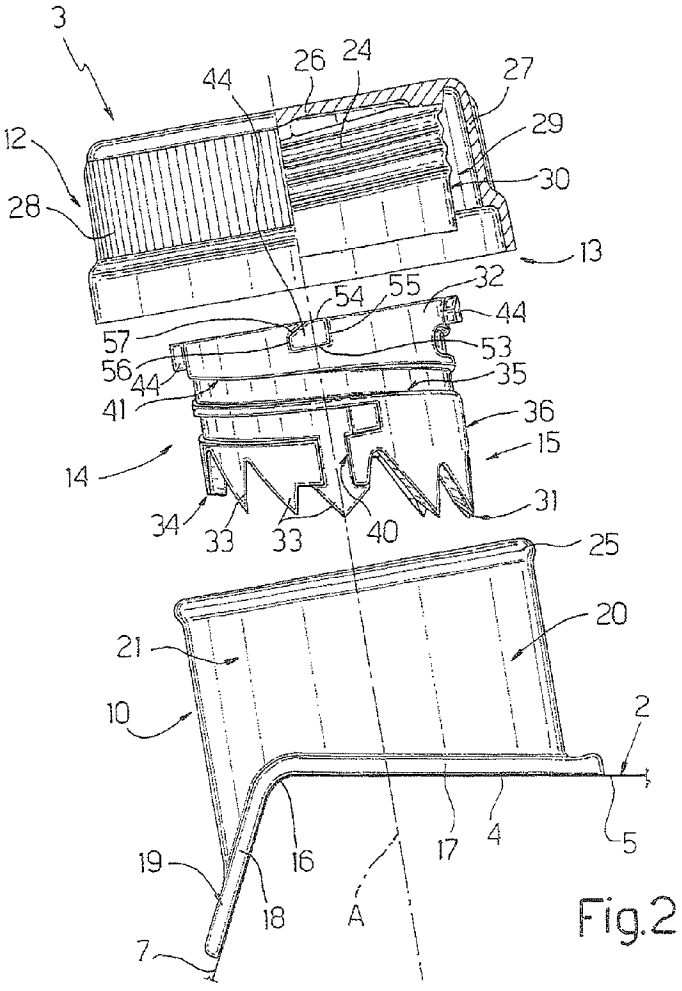
Figure 5:
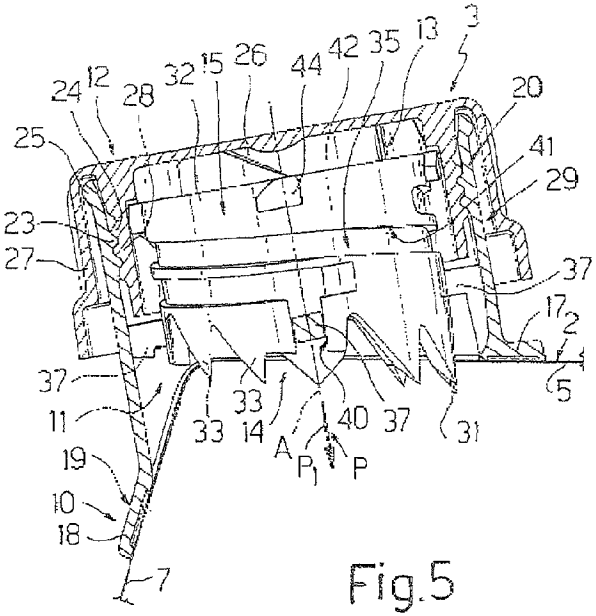

As shown, particularly in FIG. 2, each cam follower 44 is pentagonal with a first and second side 53, 54 parallel to each other and to the axial end; a third side 55 connecting first ends of sides 53 and 54; a fourth side 56 extending parallel to side 55 from an opposite axial end of side 53; and a fifth side 57, which slopes with respect to the axial end, connects the free ends of sides 54 and 56, and cooperates with and slides along portion 51 of edge 49 of relative actuating member 42 when unsealing package 1.

Figure 4:
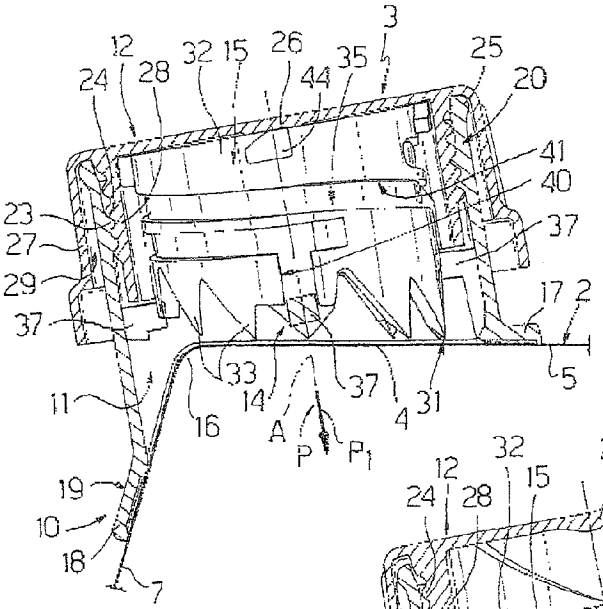
Figure 6:
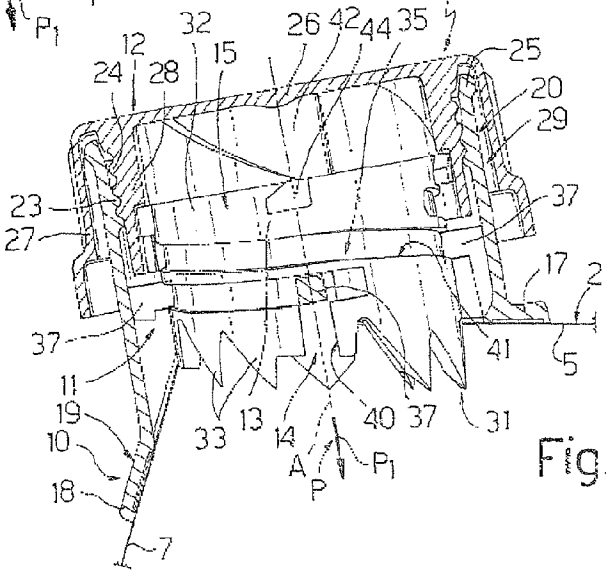

Operation of opening device 3 will now be described as of the sealed configuration of package 1 shown in FIGS. 1 and 4, in which cap 12 is screwed completely onto frame 10, and cutter 15 is housed completely inside collar 20 of frame 10, with cutting edge 31 facing the as yet uncut pierceable portion 4 (FIG. 4).

When rotated in the opening direction (anticlockwise in the drawings), cap 12 exerts control over cutter 15, by virtue of actuating members 42 engaging cam followers 44 (FIGS. 9, 10).

Over the first part of the unscrewing of cap 12 off frame 10, edge 49 of each actuating member 42 cooperates, along portion 51, with the sloping side 57 of corresponding cam follower 44; and, at the same time, each catch 37 of frame 10 engages a respective straight portion 40 of cam profile 35 of cutter 15 (FIGS. 4, 5, 6, 9, 10).

As a result of the above interactions, the first part of the unscrewing of cap 12 off frame 10 produces axial thrust on cutter 15, so that cutting edge 31 pierces pierceable portion 4.

That is, over the first part of the unscrewing of cap 12, cutter 15 is moved along axial portion $P_1$ of piercing path P.

Over the second part of the unscrewing of cap 12 off frame 10 (FIGS. 7, 8), edge 49 of each actuating member 42 cooperates, along portion 52, with side 56 of corresponding cam follower 44; and, at the same time, each catch 37 of the frame engages helical portion 41 of cam profile 35 of cutter 15.

As a result of the above interactions, the second part of the unscrewing of cap 12 off frame 10 rotates cutter 15 along helical portion $P_2$ of piercing path P defined by portion 41 of cam profile 35.

As it moves along the helical portion, cutter 15 completes the cutting of pierceable portion 4 to form a total cut of less than 360° and conveniently of 270°, so that pierceable portion 4 is not detached completely from the adjacent portions of packaging material. At the same time, the movement of cutter 15 folds the cut-off portion outwards of cutter 15 and therefore clear of opening 11 of frame 10, so the cut-off portion does not interfere with pour-out of the food product from package 1.

As cap 12 is unscrewed further, actuating members 42 and cam followers 44 disengage axially, thus arresting cutter 15 in the lowered opening position, in which it projects axially from frame 10 and inwards of package 1, but is still connected to collar 20 by catches 37 engaging portion 41 of cam profile 35.

Cap 12 is then unscrewed completely to open package 1, which can be reclosed by simply screwing cap 12 back onto collar 20.

Once package 1 is opened, cutter 15 can no longer be moved from the lowered opening position, on account of actuating members 42 being unable to reach an axial position engaging cam followers 44 of cutter 15; and, in the lowered opening position, cutter 15 holds back the cut-off part of pierceable portion 4 to prevent it clogging opening 11 through which the food product is poured.

Tests show that moving cutter 15 along a path comprising a first axial portion and a second helical portion provides for cutting pierceable portion 4 of package 1 without leaving any threads, even when using an internal layer of high-stretch heat-seal plastic material, and for correctly folding pierceable portion 4 outwards of cutter 15.

Figure 11:
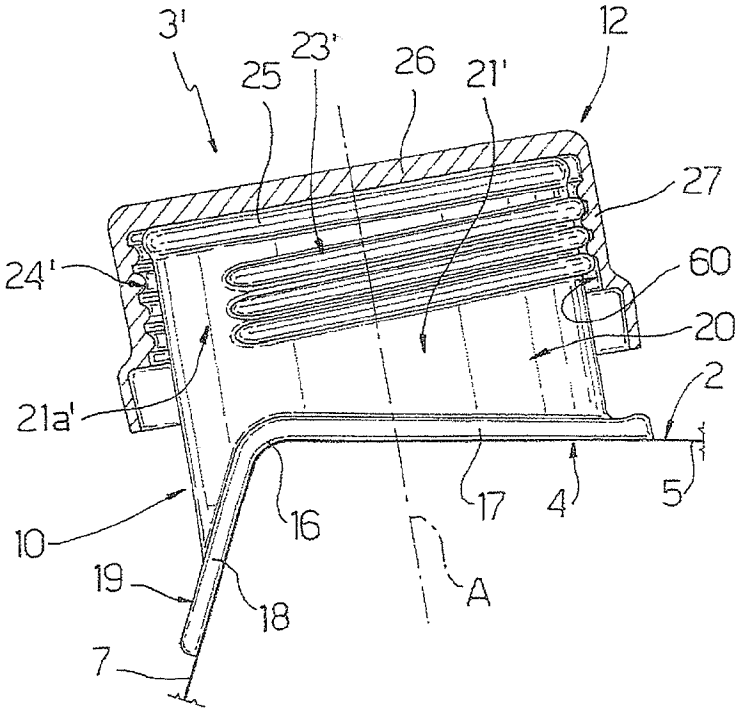
FIG. 11 shows a partly sectioned view of a variation of the opening device in FIGS. 1 to 10.

In FIG. 11, 3' indicates as a whole an opening device in accordance with a variation of the present invention, and which is described below only insofar as it differs from opening device 3, and using the same reference numbers for identical or equivalent parts already described.

Figure 12:
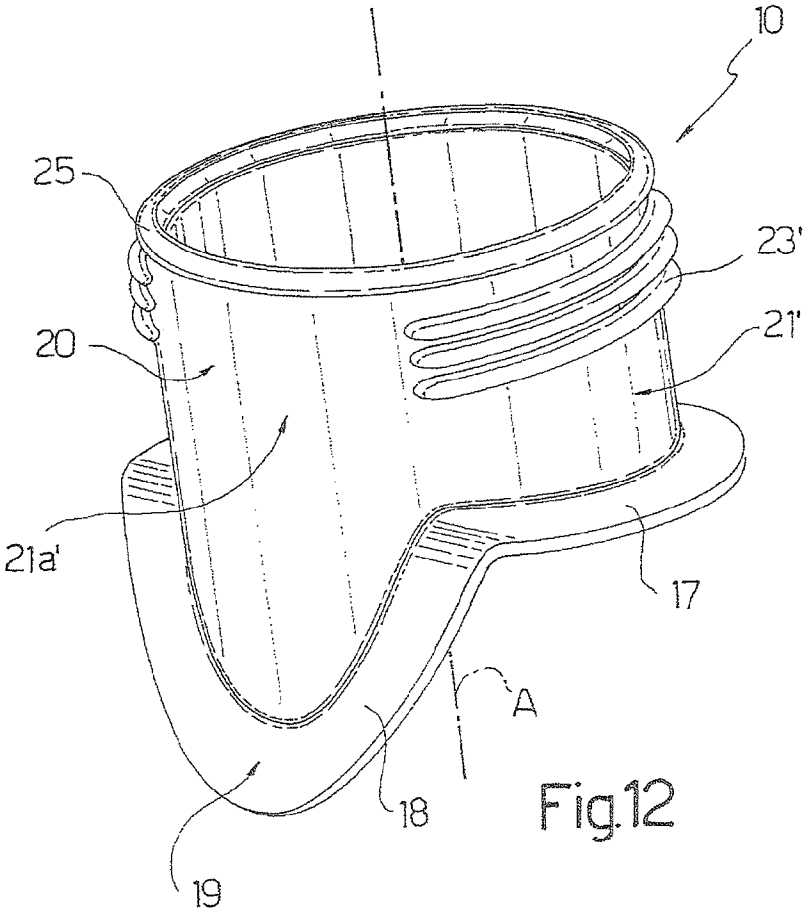
FIG. 12 shows a view in perspective of a frame of the FIG. 11 opening device.

More specifically, in opening device 3', the threads 23', 24' (FIGS. 11 and 12) of collar 20 of frame 10 and cap 12 are formed respectively on a cylindrical outer surface 21' of collar 20, which is therefore no longer completely smooth, and on an inner surface 60 of lateral wall 27 of cap 12.

More specifically, cylindrical outer surface 21' of collar 20 comprises a completely smooth portion **21*a*' extending between two distinct generating lines of surface 21' and forming a preferential supporting surface for the user's mouth when consuming the food product directly from package 1, so thread 23' of collar 20, which also extends along outer surface 21', is interrupted by smooth portion 21*a*'**.

Cap 12, on the other hand, has no lateral wall 28, and is therefore a conventional inverted-cup-shaped type.

Clearly, changes may be made to opening devices 3, 3' as described and illustrated herein without, however, departing from the scope defined in the accompanying Claims.

The invention claimed is:

1. A reclosable opening device for a sealed package of a pourable food product, said opening device having an axis, and comprising:

a frame fitted about a pierceable portion of said package, and defining a through pour opening coaxial with said axis;

a removable threaded cap that screws onto said frame to close said pour opening;

a tubular cutter engaging said pour opening and having, at one axial end, cutting means which cooperate with said pierceable portion to unseal said package;

first connecting means connecting said cap to said cutter, and which, in use, as the cap is unscrewed off the frame, push the cutter towards said pierceable portion; and second connecting means connecting said frame to said cutter, and which, in use, feed the cutter along a predetermined piercing path through said pierceable portion in response to unscrewing of said cap;

said piercing path of the cutter, as said cap is unscrewed off said frame, comprises a first portion of pure translation along said axis, followed by a second portion having both an axial component of motion and a rotary component of motion about said axis.

2. A device as claimed in claim 1, wherein said second portion of said piercing path is spiral.

3. A device as claimed in claim 1 wherein said second connecting means comprise a cam profile located on one of said frame and said cutter; and at least one catch located on the other of said frame and said cutter, and which cooperates with and slides along said cam profile.

4. A device as claimed in claim 3, wherein said cam profile comprises at least one straight first portion parallel to said axis; and a helical second portion extending about said axis.

5. A device as claimed in claim 4, wherein said cam profile is formed on an outer lateral surface of said cutter, and said catch is located on said frame; and in that said first portion of said cam profile extends from the axial end of said cutter having said cutting means, and comes out inside said second portion.

6. A device as claimed in claim 5, wherein said cam profile is a groove formed on said outer lateral surface of the cutter; and said catch is a projection projecting radially inwards of said pour opening defined by said frame.

7. A device as claimed in claim 4, wherein said cam profile comprises a number of said straight first portions equally spaced angularly about said axis, and which come out inside said helical second portion; and in that said catch is provided for each of said first portions of said cam profile.

8. A device as claimed in claim 1, wherein said first connecting means comprise one-way actuating means, by which said cap is connected rotationally to said cutter in an unscrewing direction of the cap, but is disconnected in an opposite direction.

9. A device as claimed in claim 8, wherein said one-way actuating means comprise at least one cam actuating member on said cap; and at least one corresponding cam follower located on said cutter, and which is subjected to thrust by said actuating member as said cap is unscrewed off said frame to unseal the package.

10. A device as claimed in claim 9, wherein said actuating member comprises a cam-like thrust edge, in turn comprising a first portion substantially oblique with respect to said axis, and along which unscrewing of said cap corresponds to axial thrust on said cam follower, and a second portion parallel to said axis, and along which unscrewing of said cap corresponds to rotation of said cam follower about said axis.

11. A sealed package for pourable food products, comprising a top wall and a plurality of lateral of walls which each intersect the top wall at a respective edge, the top wall and one of the lateral walls intersecting at an angle greater than 90° and less than 180°, at least a hole or a pierceable portion, and a reclosable opening device closing said hole or pierceable portion and permitting access to content of the package; said opening device comprising a frame fitted about said hole or pierceable portion and defining a through pour opening, and a removable cap fitted to said frame to close said pour opening;

wherein said frame crosses the respective edge between said top wall and said one lateral wall, and comprises a first and second portion also at an angle to each other and fixed respectively to said top wall and said one lateral wall.

12. A package as claimed in claim 11, wherein said frame of said opening device comprises an annular base flange defining said first and said second portion fastening the frame to the respective said top wall and said one lateral wall; and a tubular collar projecting from said flange, on an opposite side to that fixed to said top wall and said one lateral wall, and designed to receive said cap.

13. A package as claimed in claim 11, wherein the angle between said first and said second portion of said frame, on the side facing said two walls, is greater than 90° and less than 180°.

14. A reclosable opening device for a sealed package of a pourable food product, said opening device comprising a frame fittable about a hole or a pierceable portion of said package and defining a through pour opening, the frame comprising a base flange and a tubular collar projecting away from the base flange; and a removable cap fitted to said frame to close said pour opening; and the base flange of said frame comprises a first and a second portion at an angle greater than 90° and less than 180° to each other and attachable to respective walls of the package, also at an angle greater than 90° and less than 180° to each other, of said package, so as to extend across an edge between said walls, the second portion of the base flange extending from less than an entirety of a circumferential extent of the first portion so that a part of the circumferential extent of the first portion possesses a free edge.

15. A device as claimed in claim 14, wherein the tubular collar possesses a threaded outer surface.

16. A reclosable opening device for a sealed package of a pourable food product, said opening device comprising:

a frame having an annular base flange fitted about a hole or a pierceable portion of said package; and a tubular cylindrical collar, which projects from said flange, on an opposite side to that fixed to said package, defines a through pour opening, the tubular cylindrical collar possessing an outer cylindrical surface, an axially extending portion of the outer cylindrical surface of the collar constituting a thread region at which is located a helically extending thread; and a removable cap fitted to said collar of said frame to close said pour opening, by a thread of the cap engaging the thread of the collar;

wherein said collar comprises, along the outer cylindrical surface of the collar, at least one completely smooth portion extending between two distinct generating lines of the outer cylindrical surface and defining a comfortable support for the user's mouth when consuming the food product directly from the package, the at least one completely smooth portion extending axially through the thread region so that the helically extending thread is interrupted at least at one place between opposite axial ends of the thread;

wherein said collar comprises an outwardly-projecting annular end edge along the outer cylindrical surface of the collar that is not interrupted by the at least one completely smooth portion.

17. A device as claimed in claim 16, wherein the whole outer cylindrical surface of said collar is smooth, and said thread of said collar is formed on an opposite inner cylindrical surface defining said pour opening.

18. A device as claimed in claim 17, wherein said cap comprises a circular end wall; and two substantially cylindrical lateral walls projecting coaxially from said end wall and defining between them an annular gap loosely housing said collar of said frame; the radially inner lateral wall of said cap having, along its surface facing said gap, said thread engaging the thread of said frame.

19. A reclosable opening device for a sealed package of a pourable food product, the opening device having an axis and comprising:

a frame fitted about a pierceable portion of the package, and defining a through pour opening coaxial with the axis;

a removable threaded cap that screws onto the frame to close the pour opening;

a tubular cutter engaging the pour opening and having, at one axial end, a cutting edge cooperable with the pierceable portion to unseal the package;

projections on the cap and the cutter that are configured and arranged to engage one another when the cap is unscrewed off the frame and move the cutter towards the pierceable portion when the cap is unscrewed off the frame;

a catch and a groove, the catch being provided on one of the frame and the cutter, the groove being provided on the other of the frame and the cutter, the catch being positioned in the groove to connect the frame to the cutter, the catch and the groove being configured to move the cutter, during unscrewing of the cap, along a predetermined piercing path comprising a first portion of pure translation along the axis followed by a second portion having both an axial component of motion and a rotary component of motion about the axis so that the cutting edge penetrates the pierceable portion in response to the unscrewing of the cap.

20. A device as claimed in claim 1, wherein the projections on the cap and the cutter include a plurality of projections on the cap and a plurality of projections on the cutter.

21. A package as claimed in claim 11, wherein the reclosable opening device includes a tubular cutter possessing one axial end at which is located a plurality of circumferentially spaced apart teeth.

22. A package as claimed in claim 21, wherein the frame of the reclosable opening device includes a tubular collar, and the tubular cutter is positioned inside the tubular collar.

23. A device as claimed in claim 14, wherein the second portion of the base flange possesses a surface attachable to the respective wall of the package, the entirety of the surface of the second portion lying in a common plane.

24. A device as claimed in claim 23, wherein the first portion of the base flange possesses a surface attachable to the respective wall of the package, the entirety of the surface of the first portion lying in a common plane.

25. A device as claimed in claim 14, further comprising a tubular cutter possessing one end at which is located a plurality of circumferentially spaced apart teeth.

* * * * *